US008569645B2

(12) United States Patent
Bonjean

(10) Patent No.: US 8,569,645 B2
(45) Date of Patent: Oct. 29, 2013

(54) MAGNETIC ACTUATOR CIRCUIT FOR HIGH-VOLTAGE SWITCHGEAR

(75) Inventor: Marc Bonjean, Lunel Viel (FR)

(73) Assignee: Schneider Electric Energy France, Rueil Malmaison (FR)

( * ) Notice: Subject to any disclaimer, the term of this patent is extended or adjusted under 35 U.S.C. 154(b) by 271 days.

(21) Appl. No.: 13/254,673

(22) PCT Filed: Mar. 9, 2010

(86) PCT No.: PCT/EP2010/052949

§ 371 (c)(1),
(2), (4) Date: Sep. 2, 2011

(87) PCT Pub. No.: WO2010/102989

PCT Pub. Date: Sep. 16, 2010

(65) Prior Publication Data

US 2011/0315663 A1 Dec. 29, 2011

(30) Foreign Application Priority Data

Mar. 10, 2009 (FR) ..... 09 51492

(51) Int. Cl.
*H01H 9/40* (2006.01)

(52) U.S. Cl.
USPC ..... 218/12; 218/23; 218/104; 218/141

(58) Field of Classification Search
USPC ..... 218/12, 23, 104, 141; 361/152
See application file for complete search history.

(56) References Cited

U.S. PATENT DOCUMENTS

| | | | | |
|---|---|---|---|---|
| 3,790,862 | A * | 2/1974 | Kampf et al. | 361/152 |
| 4,860,157 | A * | 8/1989 | Russell | 361/156 |
| 5,247,419 | A * | 9/1993 | Grundmann | 361/94 |
| 5,375,027 | A | 12/1994 | Bledsoe et al. | |
| 6,013,889 | A * | 1/2000 | Wieloch | 218/22 |
| 6,888,269 | B1 | 5/2005 | Arndt et al. | |
| 7,804,038 | B2 * | 9/2010 | Bortolus et al. | 218/140 |

FOREIGN PATENT DOCUMENTS

| | | |
|---|---|---|
| DE | 296 14 718 U1 | 11/1996 |
| DE | 197 34 589 A1 | 10/1998 |
| DE | 197 31 269 A1 | 1/1999 |
| DE | 199 29 572 A1 | 1/2001 |

* cited by examiner

*Primary Examiner* — Truc Nguyen
(74) *Attorney, Agent, or Firm* — Oblon, Spivak, McClelland, Maier & Neustadt, L.L.P.

(57) ABSTRACT

A magnetic actuator circuit for high-voltage switchgear for a vacuum circuit breaker, including at least one permanent magnet and at least one coil connected in series with a transistor switch, and an electromechanical switch connected in series with the transistor switch and the coil. The first electromechanical switch and the transistor switch have an open default state, such that the electromechanical switch closes at an instant that precedes an instant of closing of the transistor switch, and such that it is returned to the open state once the transistor switch has returned to the open state. Such a magnetic actuator circuit may find application for putting a medium and/or high voltage apparatus into and out of circuit.

9 Claims, 12 Drawing Sheets

MAGNETIC ACTUATOR CIRCUIT FOR HIGH-VOLTAGE SWITCHGEAR

TECHNICAL FIELD AND PRIOR ART

The present invention relates to a magnetic actuator circuit for high-voltage switchgear that contains at least one permanent magnet and, more particularly, to a magnetic actuator circuit for high voltage apparatus for a vacuum circuit breaker.

A magnetic actuator for high voltage apparatus is used for putting a high voltage apparatus in circuit or for taking it out of circuit. The high voltage apparatus is put in circuit by closing the actuator, and it is taken out of circuit by opening the actuator.

A magnetic actuator generally has a closing coil that is used in the closing operation, together with an opening coil that is used in the opening operation.

The closing and opening coils of the magnetic actuators are mutually isolated. In spite of this isolation, there is residual magnetic coupling that persists between these coils, so that the presence of a voltage on one of the coils generates a voltage in the other coil. Thus, in the operation of closing a magnetic actuator, the voltage applied on the closing coil of that actuator generates a voltage in the opening coil because of the residual coupling between the coils. When an opening operation follows closing in rapid succession (for example when closing a short circuit), the voltage generated in the opening coil is then in opposition to the voltage of the closing signal, thereby increasing the opening current and/or the opening time.

For magnetic actuators that have electromechanical switches, the break time of the switches (that is to say the duration of the rise of current in the coil, the duration of movement of the contacts, including the duration of the electric arc) then becomes excessive. This is why transistor switches have replaced electromechanical switches, since transistor switches enable the current to be interrupted very quickly. However, one major disadvantage of transistor switches lies in the most common cause of failure of these components, namely their tendency to become short circuited. Transistor switches may become short-circuited under various circumstances, namely, for example:

- thermal runaway of a portion of the control circuit;
- over-voltage of internal origin, e.g. during an operation of the apparatus, or of external origin, e.g. in the event of lightning;
- premature ageing;
- a level of electromagnetic disturbance that is above specified values; and
- wrong monitoring/control wiring.

FIG. 1 shows, by way of example, a prior art magnetic actuator circuit for a vacuum circuit breaker with a closing coil.

The actuator circuit comprises a power supply circuit A that consists for example of a charger 1 and a capacitor 2 that is connected in parallel with the charger 1, a coil 3, a transistor switch 4, a control circuit 5 for controlling the transistor switch 4, and a permanent magnet (not shown in the figure). The permanent magnet makes it possible to lock the core of the actuator in the position corresponding to the closed state of the vacuum circuit breakers in the absence of current in the coil(s) of the actuator. The switch 3 and transistor switch 4 are connected in series and constitute, between the terminals P1 and P2, a combination that is connected in parallel with the power supply circuit A. The transistor switch 4 is for example a transistor that receives on its grid the switching control signal delivered by the circuit 5. The apparatus that is closed under the control of this actuator circuit is connected between the terminals P1 and P2 (but said apparatus is not shown in FIG. 1). In an actuator circuit of this kind, regardless of the control signal that may be applied to the grid of the transistor, an accidentally short-circuited transistor causes a permanent current to pass through the coil 3, and this current induces a force of a few hundreds to thousands of Newtons. This force causes the contacts of the vacuum circuit breaker to move a few millimeters. This movement, even if partial only so that the contacts do not touch, is unacceptable. The invention provides means that are able to eliminate this drawback.

SUMMARY OF THE INVENTION

Accordingly, the invention provides a magnetic actuator circuit for high voltage switchgear for a vacuum circuit breaker that comprises at least one coil connected in series with a transistor switch, that receives, on a control terminal, a first control signal that puts the transistor switch in a closed state or an open state, the actuator circuit being characterized in that it further comprises a first electromechanical switch connected in series with the transistor switch and coil, the first electromechanical switch being arranged to receive, on a control terminal, a second control signal that puts the first electromechanical switch into a closed or an open state, the first electromechanical switch and the transistor switch having a default state that is an open state, so that the second control signal:

a) puts the electromechanical switch in a closed state at an instant prior to the application of the first control signal that puts the transistor switch in its closed state; and b) returns the electromechanical switch to its open state once the transistor switch has been returned to its open state.

According to an additional feature of the invention, a second electromechanical switch is coupled mechanically to the first electromechanical switch, so that the first electromechanical switch and the second electromechanical switch are controlled by a common control signal, the second electromechanical switch having a first terminal connected to a detection voltage and a second terminal connected to a voltage detection circuit.

According to a further additional feature of the invention:

- a third electromechanical switch is connected in series between a first output terminal of a switch circuit that is arranged to deliver said first control signal, and the control terminal of the transistor switch; and
- an electromechanical switch, which is part of a trigger circuit that operates the control circuit, is coupled mechanically to the third electromechanical switch so that the third electromechanical switch and the electromechanical switch that is part of the trigger circuit are controlled by a common control signal.

According to a further additional feature of the invention, a signal shaping circuit is connected in series between the third electromechanical switch and the control input of the transistor switch, in such a way as to prolong the duration of the control signal that is applied to the control input of the transistor switch.

According to a further additional feature of the invention:

- a fourth electromechanical switch is connected in series between a second output terminal of a control circuit arranged for delivering the second control signal, and the control terminal of the first electromechanical switch; and
- an electromechanical switch, which is part of a trigger circuit that operates the control circuit, is coupled mechanically to the fourth electromechanical switch so that the fourth electromechanical switch and the electromechanical switch that is part of the trigger circuit are controlled by a common control signal.

According to a further additional feature of the invention, a shaping circuit is connected in series between the fourth electromechanical switch and the control input of the first electromechanical switch, in such a way as to prolong the duration of the control signal that is applied to the control input of the first electromechanical switch.

According to a further additional feature of the invention, a component connected in parallel with said coil is arranged for dissipating the energy that is released during switching operations of the magnetic actuator, by limiting over-voltages between the ends of the coil.

According to a further additional feature of the invention, the magnetic actuator circuit has two separate coils, consisting of a first coil arranged to be used for putting a high voltage apparatus in circuit and a second coil arranged to be used for taking the high voltage apparatus out of circuit.

According to a further additional feature of the invention, the coil is arranged to be used for putting on circuit, and taking out of circuit, a medium and/or high voltage apparatus.

The magnetic actuator circuit of the invention has the advantage that it avoids any accidental operation of the apparatus under its control. Because of the presence of the electromechanical switch in the actuator circuit, the current that is established in the apparatus by the actuator circuit is established therein a little more slowly than in the prior art. This additional time taken to establish the current is not however a disadvantage, because in all cases the time remains shorter, or even much shorter, than the closing or opening time of the apparatus.

BRIEF DESCRIPTION OF THE DRAWINGS

Further features and advantages of the invention appear from reading about a preferred embodiment in the description with reference to the accompanying drawings, in which.

In all the figures, the same references designate the same elements.

DETAILED DESCRIPTION OF PARTICULAR EMBODIMENTS OF THE INVENTION

Figure 1:
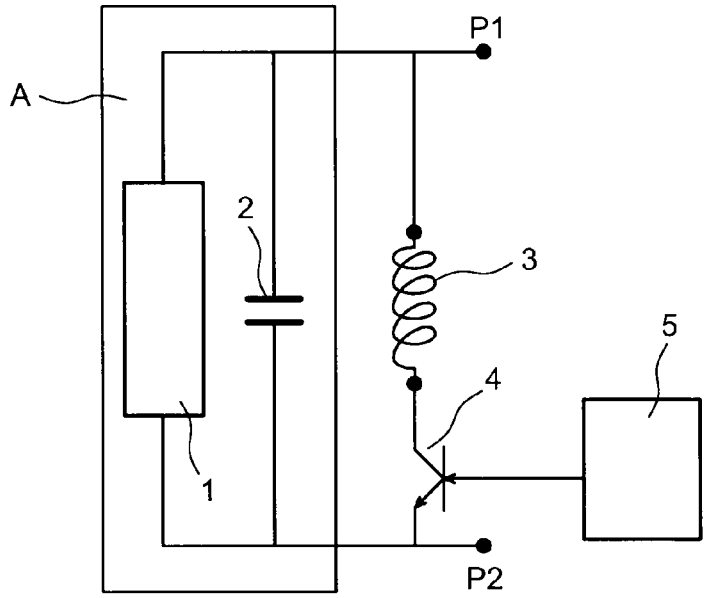
FIG. 1, already described, shows a transistor magnetic actuator circuit for a vacuum circuit breaker of the prior art having a closing coil.
Figure 2:
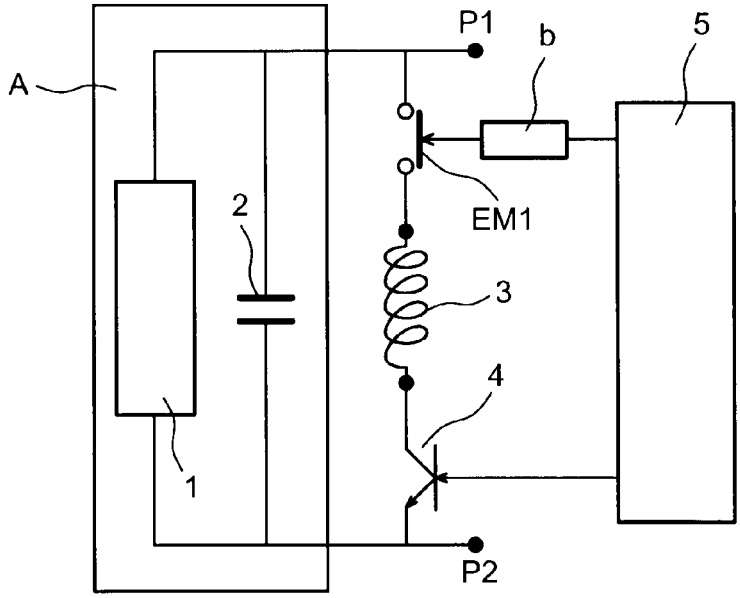
FIG. 2 shows a transistor magnetic actuator circuit for a vacuum circuit breaker of the invention having a closing coil.

FIG. 2 shows a transistor actuator circuit of the invention having a closing coil.

Besides the power supply circuit A, the permanent magnet (not shown in the figure), the closing coil 3, the transistor switch 4 and the control circuit 5, the actuator circuit of the invention includes an electromechanical switch EM1 in series with the closing coil 3. The elements EM1, 3, and 4 are connected in series between the terminals P1 and P2. A coil b is connected, in a manner known per se, on the control circuit for the electromechanical switch EM1. The control signal for the electromechanical switch EM1 is delivered by the control circuit 5. The control circuit 5 is for example a microprocessor. In the inactive state, the switches 4 and EM1 are in a blocked state (open circuit). Once it has been decided to make the transistor switch 4 conductive (transistor switch 4 closed), a control signal is applied to the switch EM1 so as to close it (i.e. to put it in the conductive state). Thus for example, 5 milliseconds before the transistor switch 4 is closed, a control signal is applied to the switch EM1 in order to close the switch EM1, which is once again opened after the transistor switch 4 has again been switched to open circuit.

Thus, except during a time period substantially identical to that of the operation of the transistor switch 4, the arm of the circuit that contains the electromechanical switch EM1, the coil 3, and the transistor switch 4 is, advantageously, open circuit. A fault in the transistor control circuit 5 (such as this component being a short circuit) does not lead to any malfunction. No inappropriate operation of the apparatus under the control of the actuator circuit is therefore possible.

The most frequent failure mode of an electromechanical switch is that the switch goes into a permanently open-circuit state. Once failure of the switch EM1 has occurred, any command to the transistor switch 4 is no longer able to produce any effect, and the apparatus that is under the control of the actuator circuit is also no longer able to be controlled. In such a fault state of the switch EM1, the apparatus that is under the control of the actuator circuit then, advantageously, continues to be protected from any inappropriate operation.

Figure 3:
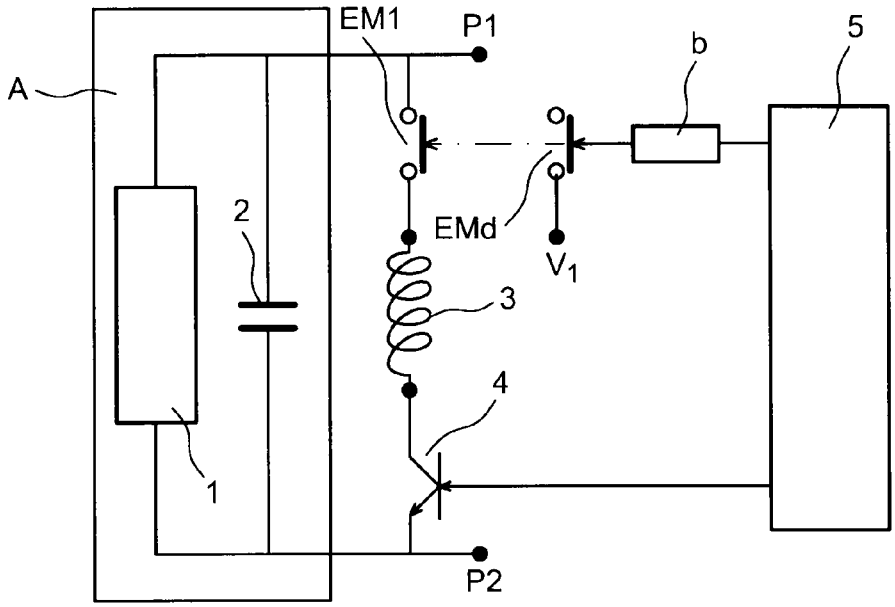
FIG. 3 shows a first improvement on the actuator circuit shown in FIG. 2.

The other failure mode of the switch EM1 is a closed-circuit mode in which it is said to be "stuck". In a first embodiment of the invention, shown in FIG. 3, the actuator circuit includes a detection means that enables the state of the closed switch (i.e. the stuck relay) to be detected, and this fault state can, advantageously, be signaled. The detection means consists of an electromechanical switch EMd. The switch EMd has a first terminal that is connected to a detection voltage $V_1$, and a second terminal connected to a control input of the control circuit 5. In a manner known per se, the switch EMd is ganged mechanically with the switch EM1, in such a way that it is the same control signal that is applied to both of these switches. The switches EMd and EM1 are therefore closed or opened simultaneously. It follows that, when the switch EM1 is in its "stuck" closed state, the switch EMd is also closed and the voltage $V_1$ is detected by the control circuit.

Figure 4:
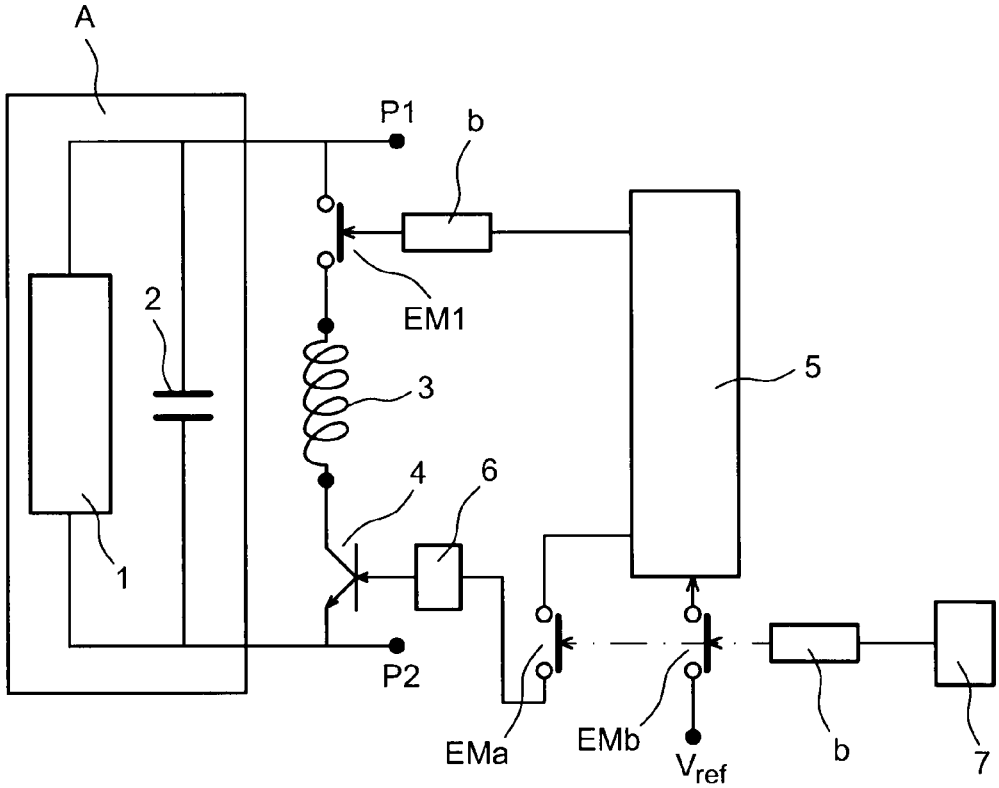
FIG. 4 shows a first version of a second improvement on the actuator circuit shown in FIG. 2.
Figure 5:
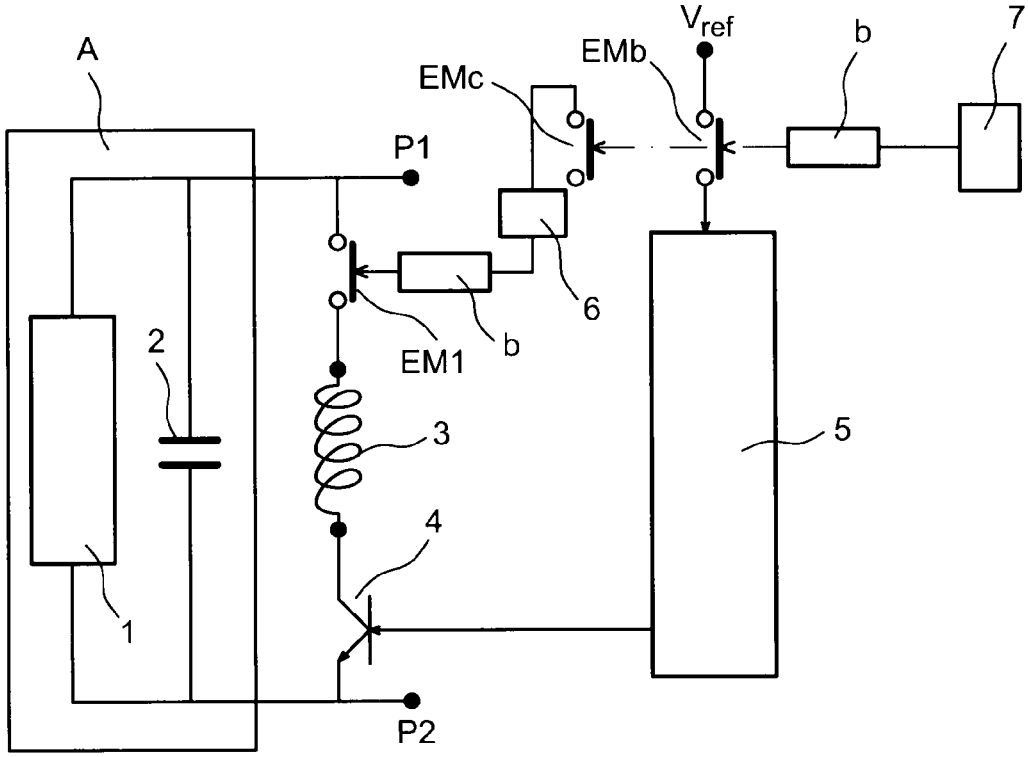
FIG. 5 shows a second version of the second improvement on the actuator circuit shown in FIG. 2.

It is possible to improve the operation of the actuator circuit by providing disconnection means, either in the control of the transistor switch 4 or in the control of the electromechanical switch EM1, as shown in FIGS. 4 and 5 respectively. In addition to the power supply circuit A, the coil 3, the electromechanical switch EM1, the coil b, the transistor switch 4 and the control circuit 5, the actuator circuit accordingly includes an additional electromechanical switch and makes use of the trigger circuit that controls the control circuit 5 in a manner known per se. The trigger circuit consists of a pulse generator 7 and an electromechanical switch EMb that has a first terminal that is connected to control input of the control circuit 5, and a second terminal that is connected to a reference voltage $V_{ref}$. The pulses delivered by the generator 7 are applied on the control terminal of the switch EMb, thereby enabling the control voltage $V_{ref}$ to be applied to the control input of the circuit 5.

FIG. 4 shows an actuator circuit of the invention in which it is the control of the transistor switch that has the disconnecting means. A third electromechanical switch EMa is connected in series between the switching control circuit 5 and the control terminal of the transistor switch. The electromechanical switches EMa and EMb are mechanically ganged together, in such a way that the same control signal is applied to both of them. Thus one control pulse delivered by the pulse generator 7 simultaneously commands the switches EMa and EMb. In the absence of any pulses delivered by the generator 7, the switch EMa is in open circuit and the advantage is obtained that no control signal is applied to the transistor switch 4. Once a pulse is delivered by the generator 7, the switch EMa closes and a control signal is applied to the transistor switch 4. The pulses delivered by the pulse generator have a duration that is generally shorter than the duration of the pulse that has to be applied to the coil of the actuator. A signal shaping circuit 6 is accordingly connected in series between the control terminal of the transistor switch 4 and the switch EMa, in order to lengthen the duration of the pulse that is applied to the transistor switch. For a pulse received for a duration substantially equal to 10 milliseconds (ms), the signal shaping circuit 6 then delivers, for example, a pulse having a duration substantially equal to 100 ms, which is a duration compatible with the duration of the pulses that should be applied to the coil of the actuator.

A circuit such as this has the advantage that it prevents any undesirable current from flowing in the coil of the actuator.

With reference to FIG. 5, it is the control of the electromechanical switch EM1 to which the disconnection means are applied. An electromechanical switch EMc is here connected in series between the control circuit 5 and the control terminal of the electromechanical switch EM1. In the same way as is described above with reference to FIG. 4, the elements EMc, EMb, 6, and 7 are used for preventing any undesirable current from flowing in the coil of the actuator.

Figure 6:
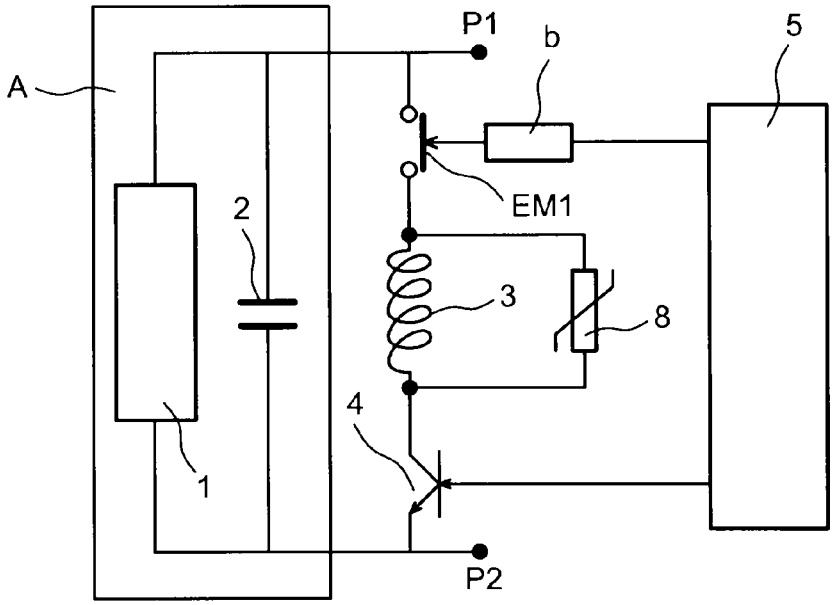
FIG. 6 shows a third improvement on the transistor actuator circuit shown in FIG. 2.

FIG. 6 shows a third improvement to the transistor actuator circuit shown in FIG. 2. In this third improvement, a component 8 is provided that is connected in parallel with the coil 3, and that may for example be a variable resistor, in which the energy released during switching operations of the actuator circuit is dissipated. Over-voltages across the coil are limited to an acceptable value, and the time during which current flows is not significantly altered.

FIGS. 2 to 6 correspond to an embodiment of the invention in which the actuator circuit has a single coil that is used exclusively as a closing coil. The invention also relates to other embodiments, namely the following:

- an embodiment in which the actuator circuit has two coils, one of which is used for closing and the other for opening; and
- an embodiment in which the actuator circuit has a single coil that is used selectively both for closing and for opening.

Figure 7A:
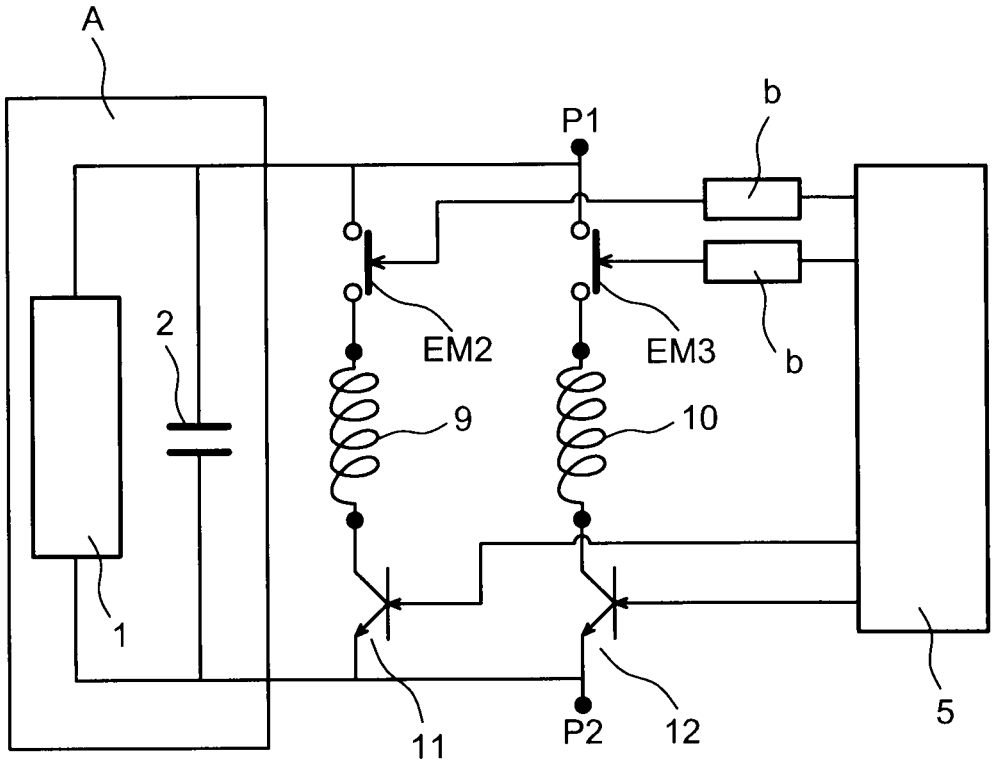
FIGS. 7A to 7D show various versions of a transistor actuator circuit of the invention having a closing coil and an opening coil.

FIG. 7A shows a first variant of a transistor actuator circuit of the invention having a closing coil and an opening coil.

The circuit includes a power supply circuit A that consists, for example, of a charger 1 and a capacitor 2, a closing coil 9 in series with an electromechanical switch EM2 and with a transistor switch 11, an opening coil 10 in series with an electromechanical switch EM3 and with a transistor switch 12, a control circuit 5 that is arranged to deliver the control signals for the various switches, and relay coils b. The elements EM2, 9, and 11 that are connected in series, together constitute a branch that is connected between the terminals P1 and P2 in parallel with the branch that consists of the series of elements EM3, 10, and 12. The switches EM2 and 11 control opening of the apparatus that is connected between the terminals P1 and P2 (not shown in FIG. 7A), and the switches EM1 and 12 control closing of the same apparatus.

All of the improvements described with reference to FIGS. 3 to 6 for the embodiment of the invention shown in FIG. 2 are applicable, mutatis mutandis, to the embodiment shown in FIG. 7A.

Figure 7B:
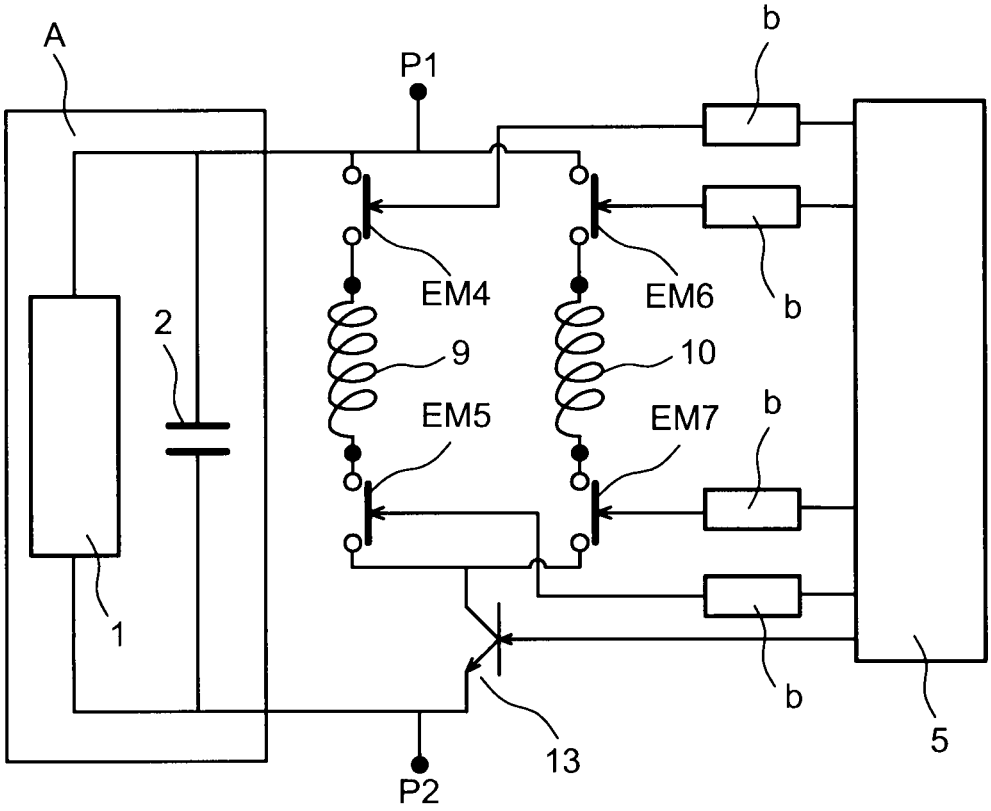

FIG. 7B shows a second variant of a transistor actuator circuit of the invention having a closing coil and an opening coil.

In this second variant, the closing coil 9 is connected in series between two electromechanical switches EM4 and EM5, and the opening coil 10 is connected in series between two electromechanical switches EM6 and EM7. The group of elements EM4, 9, and EM5 is connected in parallel with the group of elements EM6, 10, and EM7. The electromechanical switches EM4 and EM6 have a common terminal, which is the terminal P1, and the electromechanical switches EM5 and EM7 have a common terminal, which is a first terminal of a transistor switch 13 having a second terminal that is the terminal P2. In a manner known per se, coils b are connected to the control circuits for the various electromechanical switches. In the idle state, all of the switches (EM4, EM5, EM6, EM7, 13) are open (i.e. they are in their non-conductive state).

In accordance with the invention, during the operation of closing the apparatus that is connected between the terminals P1 and P2, the electromechanical switches EM4 and EM5 are closed (put in the conductive state) simultaneously in response to the control signals that are applied to them a little before the transistor switch 13 is closed (put in the conductive state), and they are simultaneously opened (put in their non-conductive state) once the transistor switch 13 has once again been switched to open circuit.

Similarly, during the opening operation, the electromechanical switches EM6 and EM7 are closed (put in the conductive state) simultaneously in response to control signals that are applied to them a little before the transistor switch 13 is closed (put in the conductive state), and they are simultaneously opened (put in their non-conductive state) once the transistor switch 13 has once again been switched to open circuit.

All of the improvements described with reference to FIGS. 3 to 6 for the embodiment of the invention shown in FIG. 2 are applicable, mutatis mutandis, to the embodiment shown in FIG. 7B.

Figure 7C:
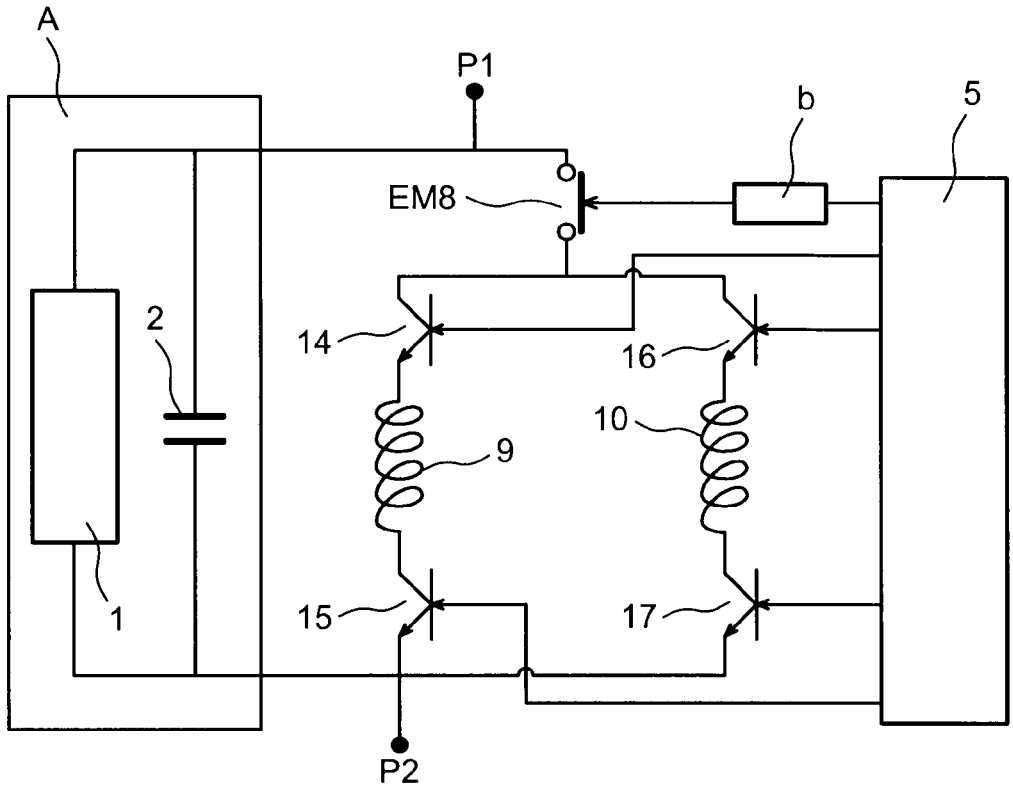

FIG. 7C shows a third variant of a transistor actuator circuit of the invention having a closing coil and an opening coil.

In this third variant, the closing coil 9 is connected in series between two transistor switches 14 and 15, and the opening coil 10 is connected in series between two transistor switches 16 and 17. The group of elements 14, 9, and 15 is connected in parallel with the group of elements 16, 10, and 17. The transistor switches 15 and 17 have a common terminal, which is the terminal P2, and the transistor switches 14 and 16 have a common terminal, which is a first terminal of an electromechanical switch EM8 having a second terminal that is the terminal P1. In a manner known per se, coils b are connected to the control circuits for the various electromechanical switches. In the idle state, all of the switches (14, 15, 16, 17, EM8) are open (i.e. they are in their non-conductive state).

In accordance with the invention, during the operation of closing the apparatus that is connected between the terminals P1 and P2, the electromechanical switch EM8 is closed (put in the conductive state) in response to a control signal that is applied to it a little before the transistor switches 14 and 15 are simultaneously closed (put in the conductive state), and is opened (put in its non-conductive state) once the transistor switches 14 and 15 have once again been switched to open circuit.

Similarly, in accordance with the invention, during the opening operation, the electromechanical switch EM8 is closed (put in the conductive state) in response to a control signal that is applied to it a little before the transistor switches 16 and 17 are simultaneously closed (put in the conductive state), and is then opened (put in its non-conductive state) once the transistor switches 14 and 15 have once again simultaneously been put in open circuit.

All of the improvements described with reference to FIGS. 3 to 6 for the embodiment of the invention shown in FIG. 2 are applicable, mutatis mutandis, to the embodiment shown in FIG. 7C.

Figure 7D:
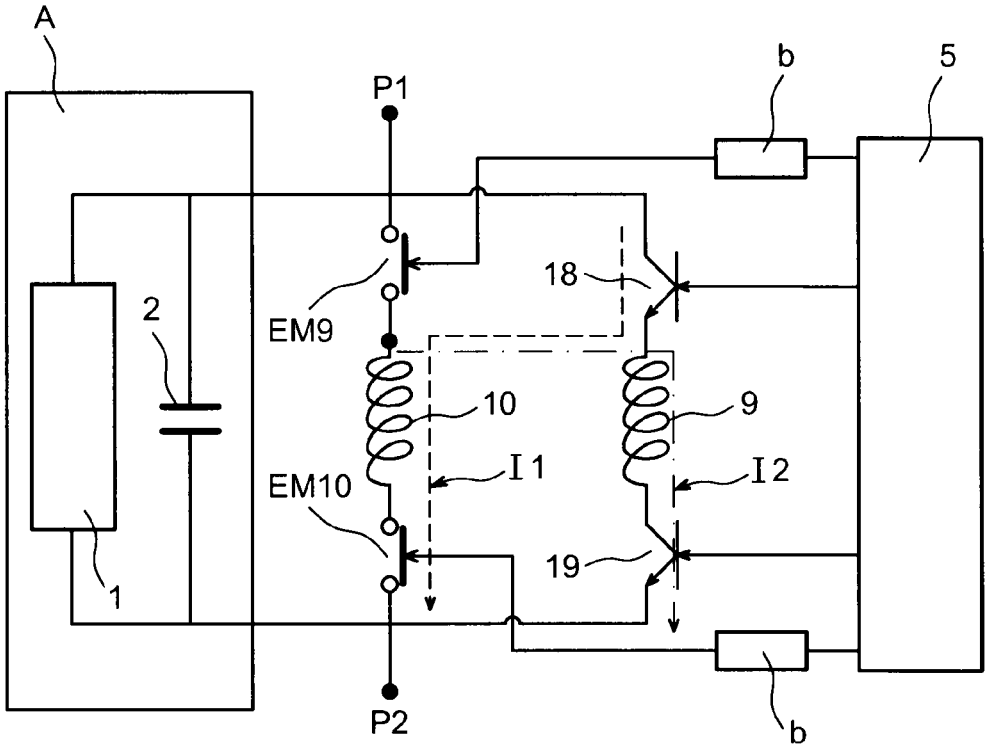

FIG. 7D shows a fourth variant of a transistor actuator circuit of the invention having a closing coil and an opening coil.

The opening coil 10 is connected in series between two electromechanical switches EM9 and EM10, and the closing coil 9 is connected in series between two transistor switches 18 and 19. A first terminal of the coil 9 is connected to a first terminal of the coil 10, and these first terminals are connected to a first terminal of the electromechanical switch EM9 and to a first terminal of the transistor switch 18, the second terminals of the electromechanical switch EM9 and transistor switch 18 being connected to the terminal P1. The second terminal of the coil 10 is connected to a first terminal of the electromechanical switch EM10, the second terminal of which is connected to the terminal P2, while the second terminal of the coil 9 is connected to a first terminal of the transistor switch 19, the second terminal of which is also connected to the terminal P2. In the idle state, all of the switches (EM9, EM10, 18, 19) are open (i.e. in their non-conductive state).

In the operation of opening the apparatus that is connected between the terminals P1 and P2, the electromechanical switch EM10 is closed a little before the transistor switch 18, and is then opened again once the transistor switch 18 has been switched to its open state. During this operation, the switches EM9 and 19 remain open. A current I1 flows in the branch consisting of the elements 18, 10, and EM10 (see FIG. 7D). During the closing operation, the electromechanical switch EM9 is closed a little before the transistor switch 19 closes, and then is opened again once the transistor switch 19 has been opened. During this operation, the switches EM10 and 18 remain open. A current I2 flows in the branch that consists of the elements EM9, 9, and 19.

All of the improvements described with reference to FIGS. 3 to 6 for the embodiment of the invention shown in FIG. 2 are applicable, mutatis mutandis, to the embodiment shown in FIG. 7D.

FIGS. 8A to 8D are described below: they illustrate several different variants of the actuator of the invention, in which the actuator has only one coil, which is used selectively both for closing and for opening. The circuits shown in FIGS. 8A to 8D correspond to the circuits shown in FIGS. 7A to 7D respectively. The word "correspond", as used here, should be understood to mean that, for the circuits concerned, the electromechanical and transistor switches are identical, and they are connected in the same way with the respective terminals P1 and P2.

Figure 8A:
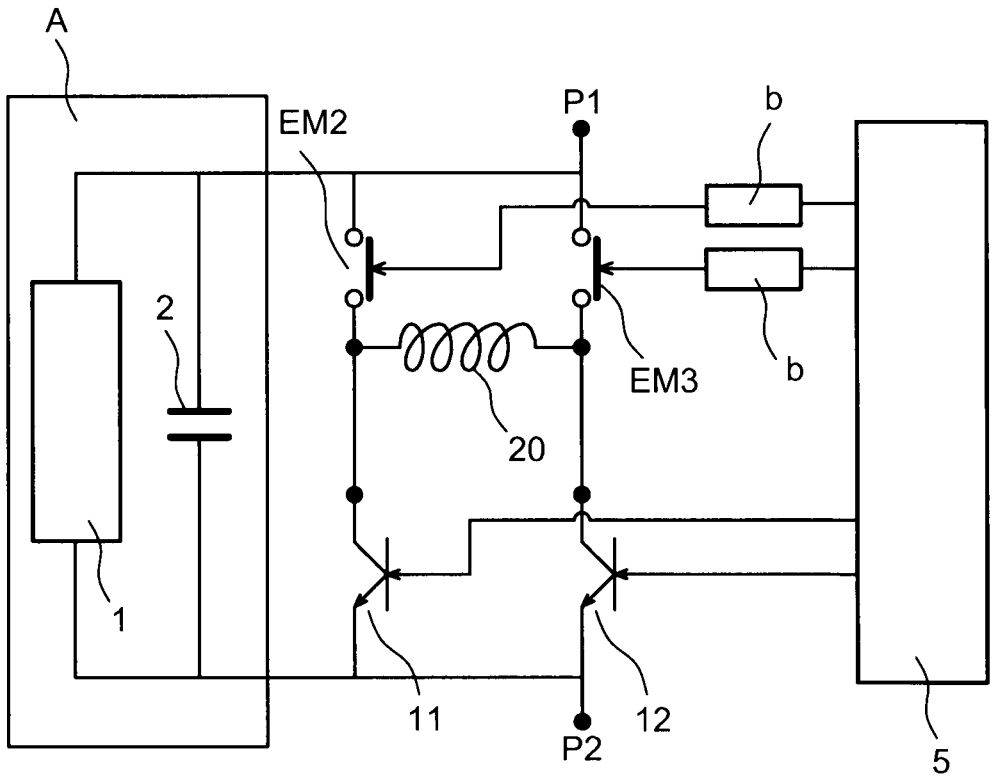
FIGS. 8A to 8D show various versions of a transistor actuator circuit of the invention having a single coil for both closing and opening.

FIG. 8A shows a first variant of a transistor actuator circuit of the invention having a single coil both for opening and for closing. This circuit corresponds to the circuit in FIG. 7A, which means that the switches EM2, EM3, 11, and 12 are connected to the terminals P1 and P2 as in the circuit of FIG. 7A.

The switches EM2 and 11 are connected in series, as are the switches EM3 and 12. A first terminal of the single coil 20 is connected to a common terminal that connects the switches EM2 and 11 together, while the second terminal of the single coil 20 is connected to a common terminal that connects the switches EM3 and 12 together. The closing circuit therefore consists of the elements EM3, 20, and 11, while the opening circuit consists of the elements EM2, 20, and 12. For the closing operation, it is the switch EM3 that has a closing time that includes the time taken to close the switch 11, with the switches EM2 and 12 remaining open, while for the opening operation it is the switch EM2 that has a closing time that includes the time taken to close the switch 12, with the switches EM3 and 11 remaining open.

All of the improvements described with reference to FIGS. 3 to 6 for the embodiment of the invention shown in FIG. 2 are applicable, mutatis mutandis, to the embodiment shown in FIG. 8A.

Figure 8B:
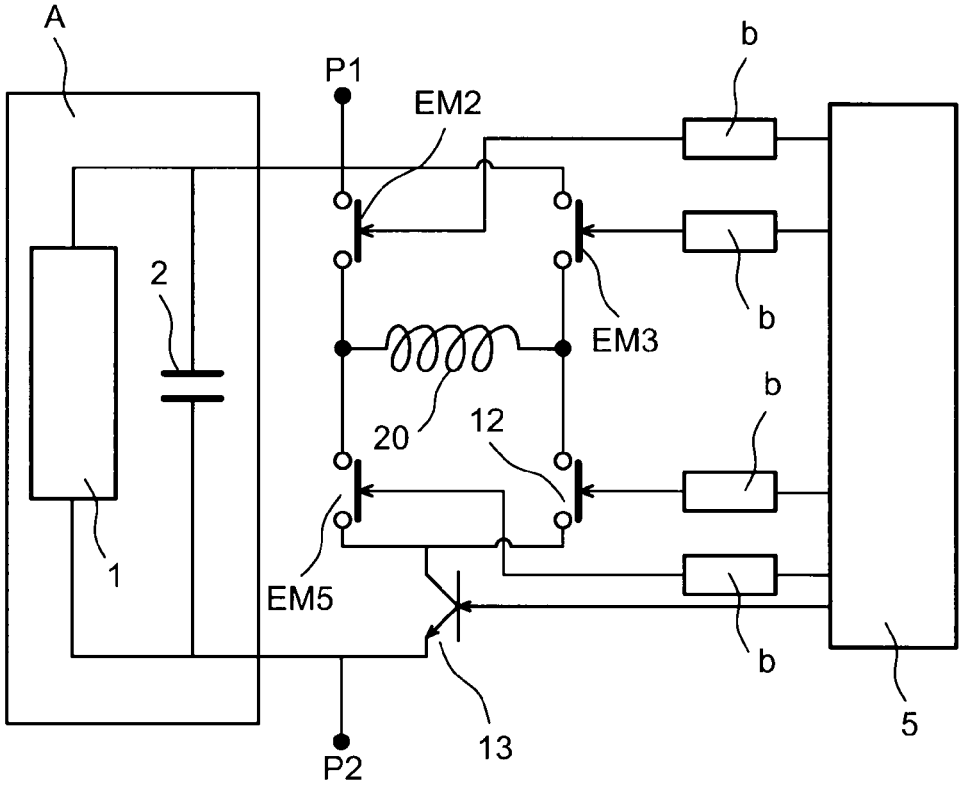

FIG. 8B shows a second variant of a transistor actuator circuit of the invention having a single coil for both opening and closing. The circuit of FIG. 8B corresponds to that of FIG. 7B. It includes the electromechanical switches EM4, EM5, EM6, and EM7, and the transistor switch 13, these switches being connected to the respective terminals P1 and P2 in the same way as in the circuit shown in FIG. 7B. The single coil 20 has a first terminal connected to a common terminal of the switches EM4 and EM5, together with a second terminal that is connected to a common terminal of the switches EM6 and EM7. The closing circuit consists of the switch EM4, the coil 20, the switch EM7 and the switch 13, while the opening circuit consists of the switch EM6, the coil 20, the switch EM5 and the switch 13. For the closing operation, it is the switches EM4 and EM7 that are closed, whereas the switches EM5 and EM6 remain open, while for the opening operation it is the switches EM5 and EM6 that are closed whereas the switches EM4 and EM7 remain open.

All of the improvements described with reference to FIGS. 3 to 6 for the embodiment of the invention shown in FIG. 2 are applicable, mutatis mutandis, to the embodiment shown in FIG. 8B.

Figure 8C:
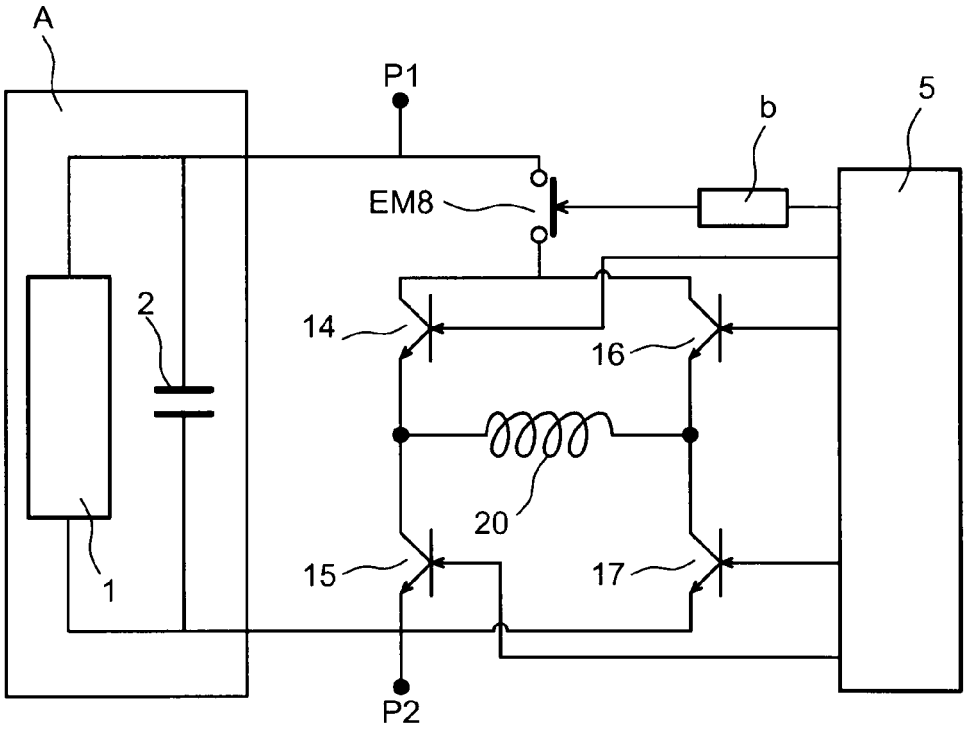

FIG. 8C shows a third variant of a transistor actuator circuit of the invention having a single coil for both opening and closing. The circuit of FIG. 8C corresponds to that of FIG. 7C. It includes four transistor switches 14, 15, 16 and 17, together with one electromechanical switch EM8. The switches EM8, 14 and 16 are connected to the terminal P1 in the same way as in the circuit shown in FIG. 7C. Similarly, the switches 15 and 17 are connected to the terminal P2 in the same way as in the circuit shown in FIG. 7C. The single coil 20 has a first terminal connected to a common terminal of the switches 14 and 15, together with a second terminal that is connected to a common terminal of the switches 16 and 17. The closing circuit consists of the switch EM8, the switch 14, the coil 20 and the switch 17, while the opening circuit consists of the switch EM8, the switch 16, the coil 20 and the switch 15. It is the same electromechanical switch EM8 that closes for the closing operation and also for the opening operation.

All of the improvements described with reference to FIGS. 3 to 6 for the embodiment of the invention shown in FIG. 2 are applicable, mutatis mutandis, to the embodiment shown in FIG. 8C.

Figure 8D:
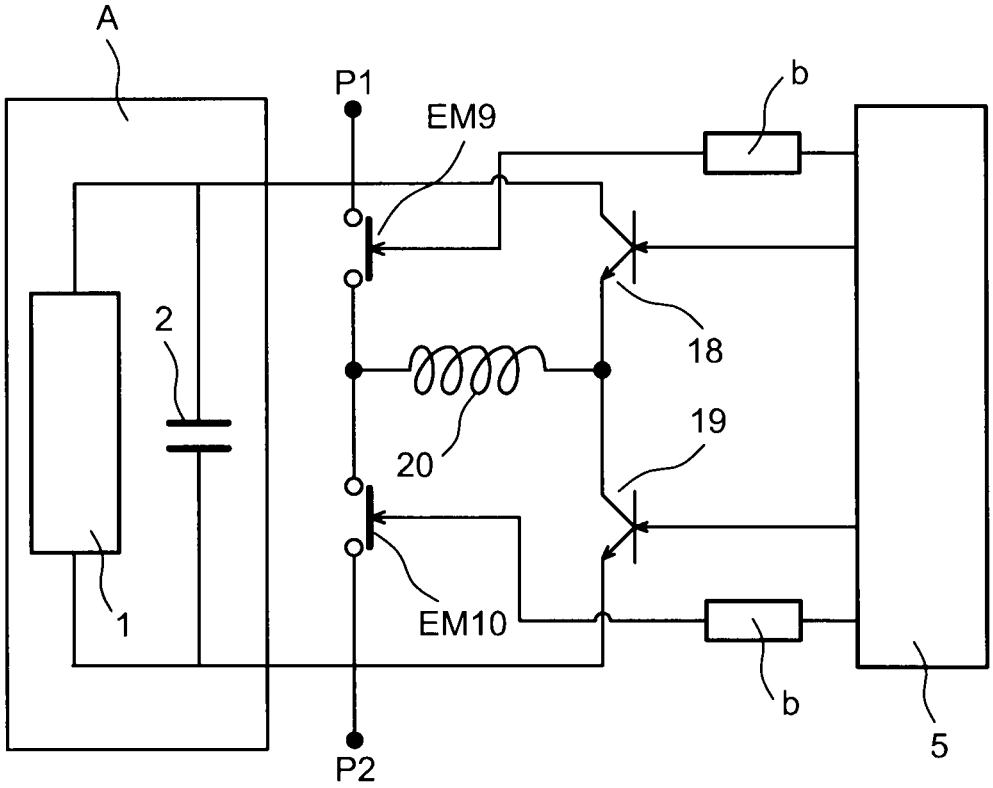

FIG. 8D shows a fourth variant of a transistor actuator circuit of the invention having a single coil for both opening and closing. The circuit in FIG. 8D corresponds to that in FIG. 7D. It comprises two electromechanical switches EM9 and EM10 and two transistor switches 18 and 19. The switches EM9 and 18 are connected to the terminal P1 in the same way as in the circuit shown in FIG. 7D. Similarly, the switches EM10 and 19 are connected to the terminal P2 in the same way as in the circuit shown in FIG. 7D. The closing circuit consists of the switch 18, the coil and the switch EM10, while the opening circuit consists of the switch EM9, the coil 20 and the switch 19. For the closing operation, it is the switch EM10 that closes, with the switch EM9 remaining open, while for the opening operation the reverse is true, so that it is the switch EM9 that closes while the switch EM10 stays open.

All of the improvements described with reference to FIGS. 3 to 6 for the embodiment of the invention shown in FIG. 2 are applicable, mutatis mutandis, to the embodiment shown in FIG. 8D.

The invention claimed is:

1. A magnetic actuator circuit for high-voltage switchgear for a vacuum circuit breaker, comprising:

at least one permanent magnet and at least one coil connected in series with a transistor switch that receives, on a control terminal, a first control signal that puts the transistor switch in a closed state or an open state;

a first electromechanical switch connected in series with the transistor switch and coil, the first electromechanical switch being arranged to receive, on a control terminal, a second control signal that puts the first electromechanical switch into a closed or an open state, the first electromechanical switch and the transistor switch having a default state that is an open state, so that the second control signal:

a) puts the electromechanical switch in a closed state at an instant prior to application of the first control signal that puts the transistor switch in its closed state; and b) returns the electromechanical switch to its open state once the transistor switch has been returned to its open state.

2. An actuator circuit according to claim 1, further comprising:

a second electromechanical switch coupled mechanically to the first electromechanical switch, so that the first electromechanical switch and the second electromechanical switch are controlled by a common control signal, the second electromechanical switch including a first terminal connected to a detection voltage and a second terminal connected to a voltage detection circuit.

3. An actuator circuit according to claim 1, further comprising:

a third electromechanical switch connected in series between a first output terminal of a control circuit that is arranged to deliver the first control signal, and the control terminal of the transistor switch; and an electromechanical switch that is part of a trigger circuit, that operates the control circuit, coupled mechanically to the third electromechanical switch so that the third electromechanical switch and the electromechanical switch that is part of the trigger circuit are controlled by a common control signal.

4. An actuator circuit according to claim 3, further comprising a signal shaping circuit connected in series between the third electromechanical switch and the control input of the transistor switch, so as to prolong duration of the control signal that is applied to the control input of the transistor switch.

5. An actuator circuit according to claim 1, further comprising:

a fourth electromechanical switch connected in series between a second output terminal of a control circuit arranged for delivering the second control signal, and the control terminal of the first electromechanical switch; and an electromechanical switch, which is part of a trigger circuit that operates the control circuit, coupled mechanically to the fourth electromechanical switch so that the fourth electromechanical switch and the electromechanical switch that is part of the trigger circuit are controlled by a common control signal.

6. An actuator circuit according to claim 5, further comprising a signal shaping circuit connected in series between the fourth electromechanical switch and the control input of the first electromechanical switch, so as to prolong duration of the control signal that is applied to the control input of the first electromechanical switch.

7. An actuator circuit according to claim 1, further comprising a component connected in parallel with that coil arranged for dissipating energy that is released during switching operations of the magnetic actuator, by limiting overvoltages between the ends of the coil.

8. An actuator circuit according to claim 1, comprising two separate coils, of a first coil arranged to be used for putting a high voltage apparatus in circuit and a second coil arranged to be used for taking the high voltage apparatus out of circuit.

9. An actuator circuit according to claim 1, wherein the coil is arranged to be used for putting in circuit, and taking out of circuit, a medium and/or high voltage apparatus.

* * * * *